US008621895B2

(12) United States Patent
Kim

(10) Patent No.: US 8,621,895 B2
(45) Date of Patent: Jan. 7, 2014

(54) DRUM TYPE WASHING MACHINE

(75) Inventor: Soo Bong Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 2294 days.

(21) Appl. No.: 11/536,862

(22) Filed: Sep. 29, 2006

(65) Prior Publication Data

US 2007/0074542 A1 Apr. 5, 2007

(30) Foreign Application Priority Data

Sep. 30, 2005 (KR) ..... 10-2005-0092367
Sep. 30, 2005 (KR) ..... 10-2005-0092368
Sep. 30, 2005 (KR) ..... 10-2005-0092369
Sep. 30, 2005 (KR) ..... 10-2005-0092370
Sep. 30, 2005 (KR) ..... 10-2005-0092371

(51) Int. Cl.
*D06F 37/30* (2006.01)

(52) U.S. Cl.
USPC ..... 68/140

(58) Field of Classification Search
USPC ..... 68/140
See application file for complete search history.

(56) References Cited

U.S. PATENT DOCUMENTS 5,862,686 A 1/1999 Skrippek ..... 68/140
2004/0163428 A1* 8/2004 Kim et al. ..... 68/140
2005/0028568 A1* 2/2005 Koch et al. ..... 68/142
2005/0189838 A1 9/2005 Lee ..... 310/217

FOREIGN PATENT DOCUMENTS

EP 1 529 870 A1 5/2005
KR 10-2001-0037670 A 5/2001
KR 10-2004-0007762 A 1/2004
KR 10-2005-0043558 A 5/2005
KR 10-0489982 B1 5/2005
KR 10-2005-0053211 A 6/2005
KR 10-2005-0056677 A 6/2005
KR 10-2005-0073219 A 7/2005
KR 10-2005-0087275 A 8/2005

OTHER PUBLICATIONS

German Office Action dated Nov. 27, 2009 for Application No. 10 2006 046 289.0.

* cited by examiner

*Primary Examiner* — Michael Barr
*Assistant Examiner* — Jason Riggleman
(74) *Attorney, Agent, or Firm* — KED & Associates LLP

(57) ABSTRACT

A drum type washing machine is provided which includes a tub having a fastening part formed on a rear wall thereof, a stator fastened to the fastening part of the tub, the stator having a core part having teeth formed thereon, a coil wound around the teeth, a first insulator that covers a front surface of the core part and a second insulator that covers a rear surface of the core part, a stator rib formed on a front surface of the first insulator, and a supporting part that projects from the rear wall of the tub that supports the stator rib in an up-and-down direction when the stator is fastened to the fastening part of the tub.

18 Claims, 20 Drawing Sheets

DRUM TYPE WASHING MACHINE

This application claims the benefit of the Patent Korean Application Nos. 10-2005-0092367, 10-2005-0092368, 10-2005-0092369, 10-2005-0092370, and 10-2005-0092371 filed on Sep. 30, 2005, which are hereby incorporated by reference as if fully set forth herein.

BACKGROUND OF THE INVENTION

1. Field of the Invention

The present invention relates to a drum type washing machine, more particularly, to a drum type washing machine having an improved structure of a driving part.

2. Discussion of the Related Art

In general, a drum type washing machine is classified into an indirect drive motor drum type washing machine and a direct drive motor drum type washing machine. In the indirect drive motor drum type washing machine, driving power of a motor is indirectly transmitted to a drum via a motor pulley and a belt wound around a drum pulley. Whereas, in the direct drive motor drum type washing machine, a rotor of a BLDC motor (Brushless DC motor) is directly connected to a drum to transmit driving power of a motor to a drum.

The indirect drive motor drum type washing machine may cause energy loss or severe noise in the process of transmitting the driving power, because the driving power is not directly transmitted to the drum, but indirectly transmitted to the drum via the motor pulley and the belt.

Thus, to solve the above problem, demands for a direct drive motor drum type washing machine (hereinafter, a DDM drum type washing machine) have been accordingly increasing, which adapts a BLDC motor.

Referring to FIG. 1, a structure of a conventional DDM drum washing machine will be described briefly.

FIG. 1 is longitudinally sectional view of a conventional drum type washing machine. The conventional drum type washing machine includes a cabinet 1, a tub 2 mounted within the cabinet 1 and a drum rotatably mounted within a center of the tub 2.

A motor having a stator 6 and a rotor 5 is mounted in a rear of the tub 2. The stator 6 is fixed to a rear wall of the tub 2 and the rotor 5 is fastened to the drum 3 by a shaft 4, passing through the stator.

FIG. 2 is a cut-away perspective view illustrating some portion of a rear wall of the tub.

Here, a bearing housing 7 is provided in the rear wall center of the tub 2 to support a bearing as well as to fasten the stator 6 to the tub 2. The bearing is installed on each outer circumferential surface of both terminal ends of a shaft 4.

The rear wall of the tub 2 includes a step part 21 and a non-step part 22. A fastening part 23, which will be described later, is stepped on a center portion of the step part 21, where the bearing housing 7 is provided, to be fastened to the stator 6. A plurality of reinforcement ribs 22*a* are formed on the non-step part 22.

FIG. 3 is a perspective view illustrating an exterior of the stator 6. The conventional stator 6 includes a core part 61 having a ring shape for winding a coil 66 thereto, an insulator 62 and 63, a hall sensor assembly 64 and a tap housing assembly 65 for power connection.

The insulator 62 and 63 includes a first insulator 62 and a second insulator 63 for covering an upper and lower surface of the core part 6. A plurality of projection parts 62*a* and 63*a* are projected toward a center of the first and second insulator 62 and 63 to form a fastening hole 62*b* and 63*b* therein. The projection part 62*a* and 63*a* may be formed as one body with the first and second insulator 62 and 63, or alternatively some portion of the core part 61 may projected to form the projection part 62*a* and 63*a*.

Each fastening hole 62*b* and 63*b* is fastened to the fastening part 22 of the tub rear wall by a bolt.

At that time, a plurality of position determination protrusions 62*c* are formed on the projection part 62*a* of the first insulator 62 to determine the position where the stator 6 is fastened to the tub 2. A plurality of position determination holes 23*a* are formed on the fastening part 23 of the tub rear wall to insert the position determination protrusions 62*c* therein.

Thus, after the position of the stator 6 is determined by the position determination protrusions 62*c* and holes 23*a*, the stator 6 and the tub 2 are fastened each other through the fastening holes 62*b* and 63*b*.

However, since in the fastening structure between the stator 6 and the tub 2 each position determination protrusion 62*c* is formed in a pin shape having a narrow diameter, there is a problem that the position determination protrusion 62*c* may be easily damaged during the assembly or the transportation thereof.

Due to the damage of the position determination protrusion 62*c*, the process of fastening the stator 6 to the tub 2 may not be performed smoothly.

Specifically, in a drum type washing machine which directly rotates a drum 3 by using a BLDC motor as shown in FIG. 4, the stator 6 is directly fastened to a fixed portion of the tub rear wall. But, since the weight of only the stator is 1.5 kg and the spinning rotation speed of a motor for a drum type washing machine having a large capacity is 600~2,000 RPM. Thus, the fastening portion between the stator 6 and the tub 2 is easily damaged due to the weight of the stator 6, vibration in high speed rotation, and shake/deformity of the rotor 5.

Still more, since in a drum type washing machine which uses a BLDC motor and fastens the stator 6 to the tub 2, the radius direction of the stator 6 is perpendicular to the floor, the damage of the fastening portion between the stator 6 and the tub 2 may getting severed.

Accordingly, a tub supporter (not shown) made of metal for covering most of the tub rear wall should be arranged between the tub 2 and the stator 6 to prevent the damage. However, in that case, an additional assembly work for fastening the tub supporter to the tub rear wall should be added, such that a disadvantage of low productivity may be caused thereby.

SUMMARY OF THE INVENTION

Accordingly, the present invention is directed to a drum type washing machine.

An object of the present invention is to provide a drum type washing machine which has an improved structure of a driving part.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washing machine includes a tub having a fastening part formed on a rear wall thereof; a stator fastened to the fastening part of the tub, the stator having a core part having teeth formed thereon, a coil wound around the teeth, a first insulator for covering a front surface of the core part and a second insulator for covering a rear surface of the core part; a rotor provided in an outer portion of the stator to be comprised in a motor together with a stator; a stator rib formed on an inner front surface of the first insulator with respect to the radial direction of the portion of the first insulator where the coil is wound; and a supporting part provided on a rear wall of the tub to support the stator rib when the stator is fastening to the fastening part of the tub.

Here, the stator rib may include a partition rib for separating the portion where the stator is fastened to the fastening part from the portion where the coil is wounded.

The supporting part may include a supporting rib for supporting an inner wall of the partition rib when the stator is fastened to the fastening part of the tub.

A plurality of step parts and non-step parts may be formed on the rear wall of the tub in a radial direction the step part may be a portion where a bearing housing is provided and the non-step part may be a portion where the bearing housing is not provided.

Here, the supporting rib may be provided on the non-step part of the tub or formed on the non-step part as one body.

A plurality of reinforcement beads may be formed in the non-step part to reinforce strength of the non-step part, and the supporting rib is fixed to each reinforcement bead. Alternatively, the supporting rib may be formed as one body with the reinforcement bead.

The supporting rib may be provided as an auxiliary piece separated from the tub to be fastened to the non-step part of the tub.

The supporting rib may be positioned in the partition rib and high enough to be contacted with an inner wall of the partition wall, not contacted with a front surface of the first insulator when the stator is fastened to the fastening part of the tub.

The supporting part may further include a sub-supporting rib for cover an outer wall of the partition rib when the stator is fastened to the fastening part of the tub. Alternatively, the supporting part may include only the sub-supporting rib, because the stator is fixed to the rear wall of the tub with being approximately perpendicular to the floor. Thus, if the supporting part supports the inner wall of the partition rib, the supporting part provided in an upper portion of the stator can fully support the partition rib and the supporting part provided in a lower portion of the stator cannot fully support the partition rib enough. Whereas, if the supporting rib supports the outer wall of the partition rib, the supporting part provided in the upper portion of the stator cannot fully support the partition rib. However, the supporting part provided in the lower portion of the stator can fully support the partition rib.

Accordingly, it is preferred that the supporting part may include both the supporting rib and the sub-supporting rib, and the supporting part may include either of the two.

The supporting rib may be provided in the step part of the tub. In that case, the supporting rib can be connected to a hall sensor assembly or a tap housing assembly for power connection. Thus, the right-and-left direction width of the supporting rib may be determined to make the fastening portion of the stator corresponding to the fastening position of the tub, in case that the supporting rib is contacted with any one side surface of a hall sensor assembly provided in the first insulator or of a tap housing assembly for power connection.

The supporting rib has a predetermined friction force in a state of being closely contacted with the inner wall of the partition rib to prevent the partition rib from moving. In that case, the supporting rib is made of rubber having compressibility. Meanwhile, in case that the supporting rib is made of robber having compressibility, the supporting rib may move somewhat. Thus, the supporting part may further include a motion-proof bump formed in an outer portion with respect to a radial direction of the supporting rib to prevent the supporting part from moving.

The supporting rib may be formed in a ring shape to surround the fastening part of the tub. In that case, the supporting rib is crossing the step parts and non-step parts. Alternatively, the supporting rib may be formed as one body with the rear wall of the tub. The supporting rib also may be provided as an auxiliary piece separated from the rear wall of the tub and fastened to the rear wall of the tub.

Preferably, a fixing part may be formed on the portion of each supporting rib and projected toward each reinforcement bead to be fixed between the reinforcement beads.

The stator rib may include a winding rib projected forwardly along a front surface circumference of the first insulator to wind a connection wire of the coil there around, and may further include the supporting rib together with the winding rib.

In that case, the supporting part may be a bracket having a front surface thereof fastened to the tub and a rear surface thereof fastening the winding rib thereto.

A fastening hole may be formed on the bracket and the winding rib is inserted in the fastening hole to be fastened to the bracket. The supporting part and the tub may be made of different materials or injection-molded in the rear wall of the tub, and alternatively may be fastened to the rear wall as an auxiliary piece.

The drum type washing machine according to the present invention has following advantageous effects.

First, since the supporting part is additionally provided on the rear wall of the tub, the fastening position of the stator can be determined more precisely and smoothly when assembling the stator.

Second, even when vibration is generated during the washing or spinning cycle, the damage of the fastening portion between the stator and the tub can be prevented.

Finally, since the tub supporter in the prior art may be removed, the production process can be simple and production cost can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
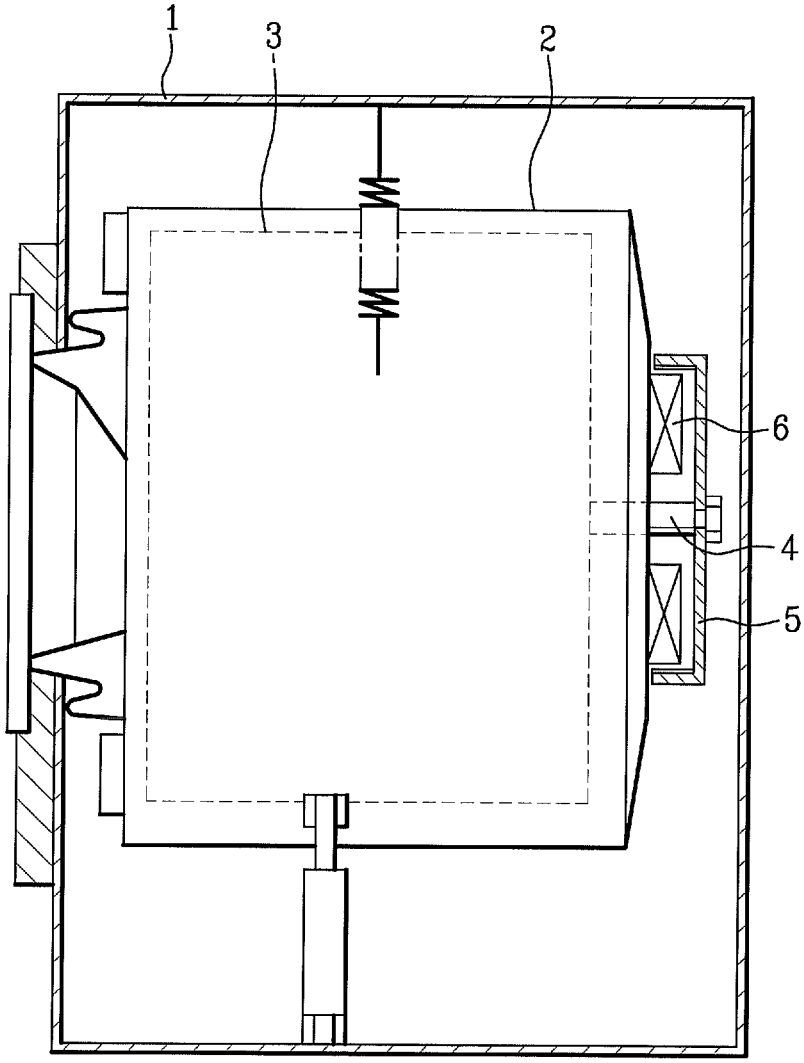
FIG. 1 Related Art
FIG. 1 is a longitudinal sectional view schematically illustrating a structure of a conventional DDM drum type washing machine.
Figure 2:
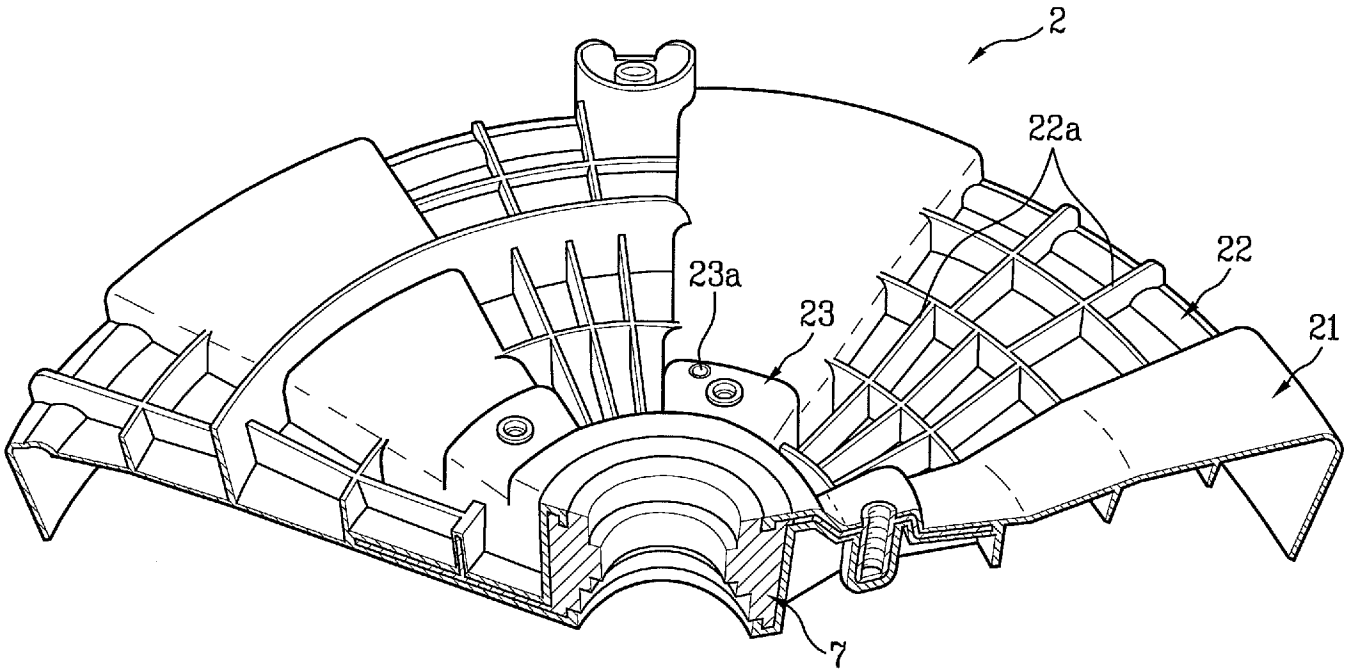
FIG. 2 Related Art
FIG. 2 is a cut-away perspective view illustrating some part of a rear wall of a tub according to the conventional DDM drum type washing machine.
Figure 3:
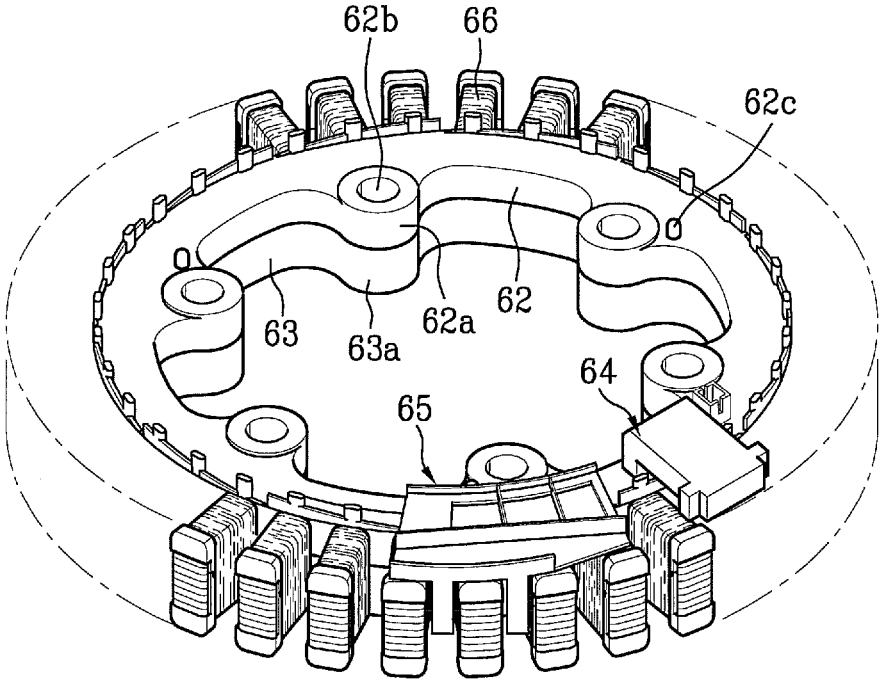
FIG. 3 Related Art
FIG. 3 is a perspective view of a stator according to the conventional DDM drum type washing machine.
Figure 4:
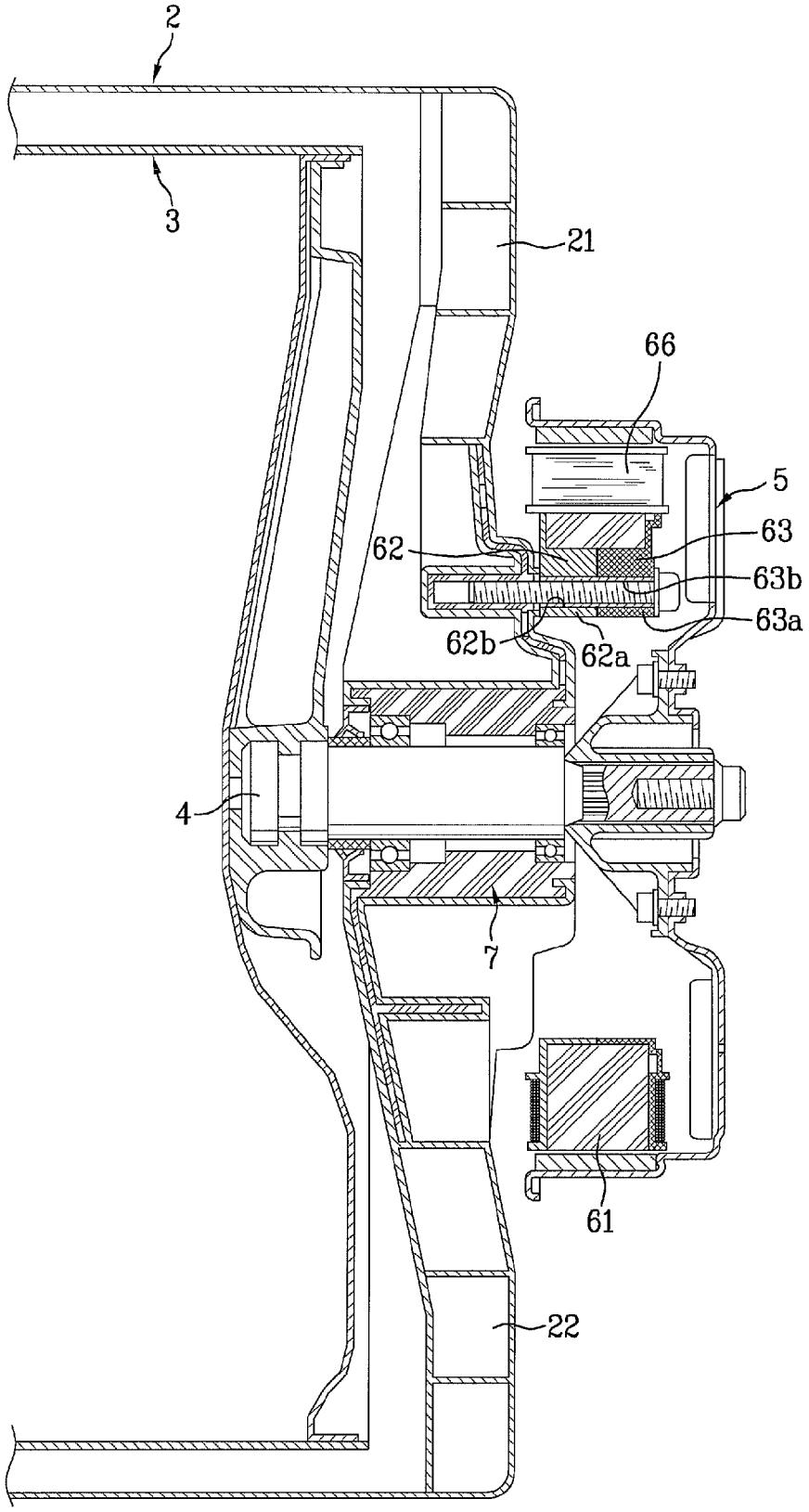
FIG. 4 Related Art
FIG. 4 is a longitudinal sectional view illustrating a fastening structure between the tub and the stator according to the conventional DDM drum type washing machine.
Figure 5:
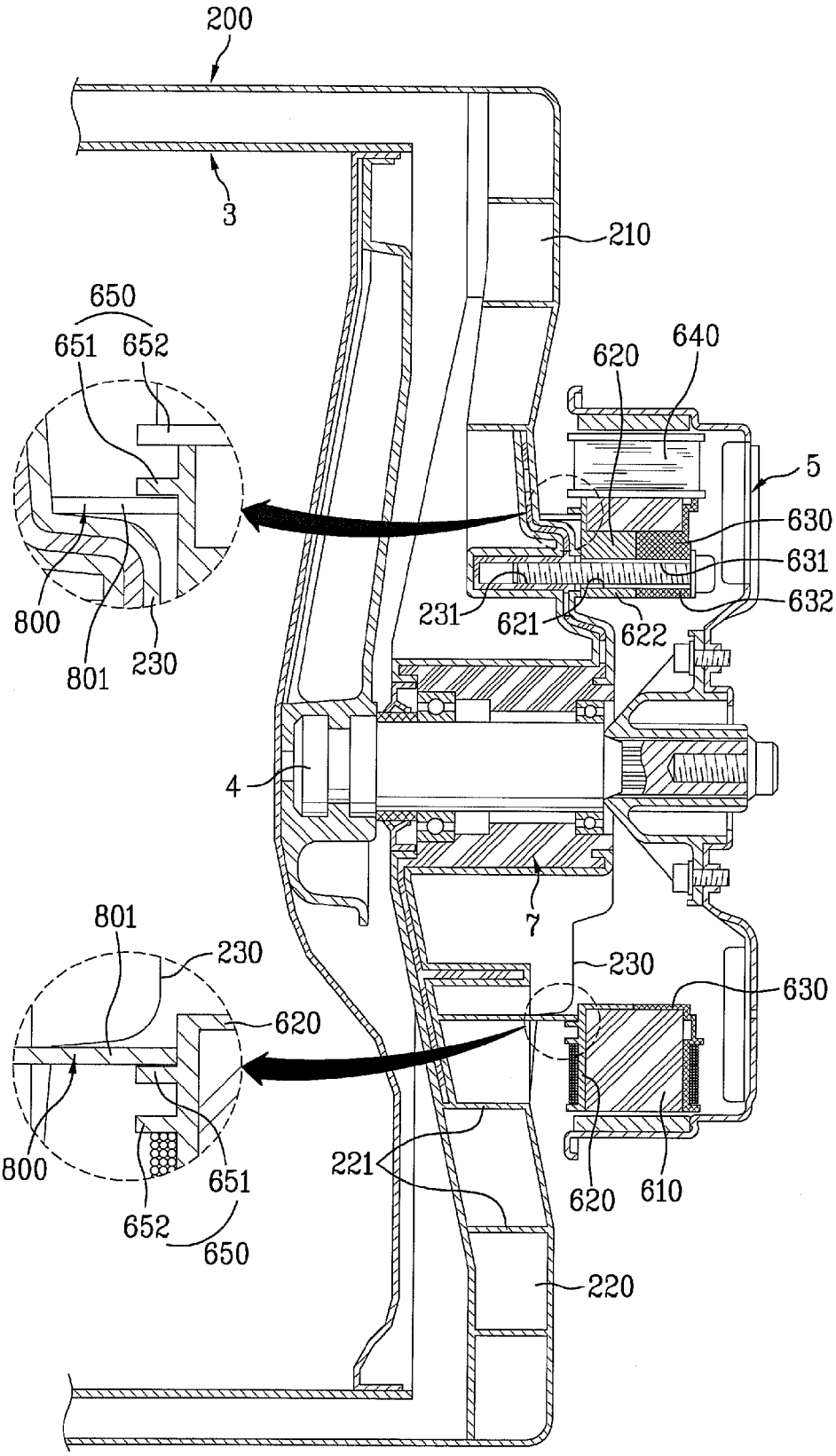
FIG. 5 is a longitudinal sectional view illustrating a fastening structure between a tub and a stator in a DDM drum type washing machine according to a first embodiment of the present invention.

FIG. 5 is a longitudinal sectional view schematically illustrating a DDM drum type washing machine according to the present invention.

As shown in FIG. 5, the drum type washing machine according to the present invention includes a tub 200, a stator 600 and a rotor 5.

The tub 200 is mounted within a cabinet 1 to store wash water therein and a drum 3 is rotatably mounted within the tub 200. At that time, the tub 200 has a rear wall for fixing the stator 600 thereto.

The tub 200 is made of plastic and a bearing housing 7 made of metal is provided in a center of the tub rear wall to support a bearing as well as to fasten the stator 600 thereto.

Here, the bearing housing 7 is made of aluminum alloy and the like and inserted in the tub 200 when the tub 200 is injection-molded, such that it is formed as one body with the rear wall of the tub 200.

Figure 6:
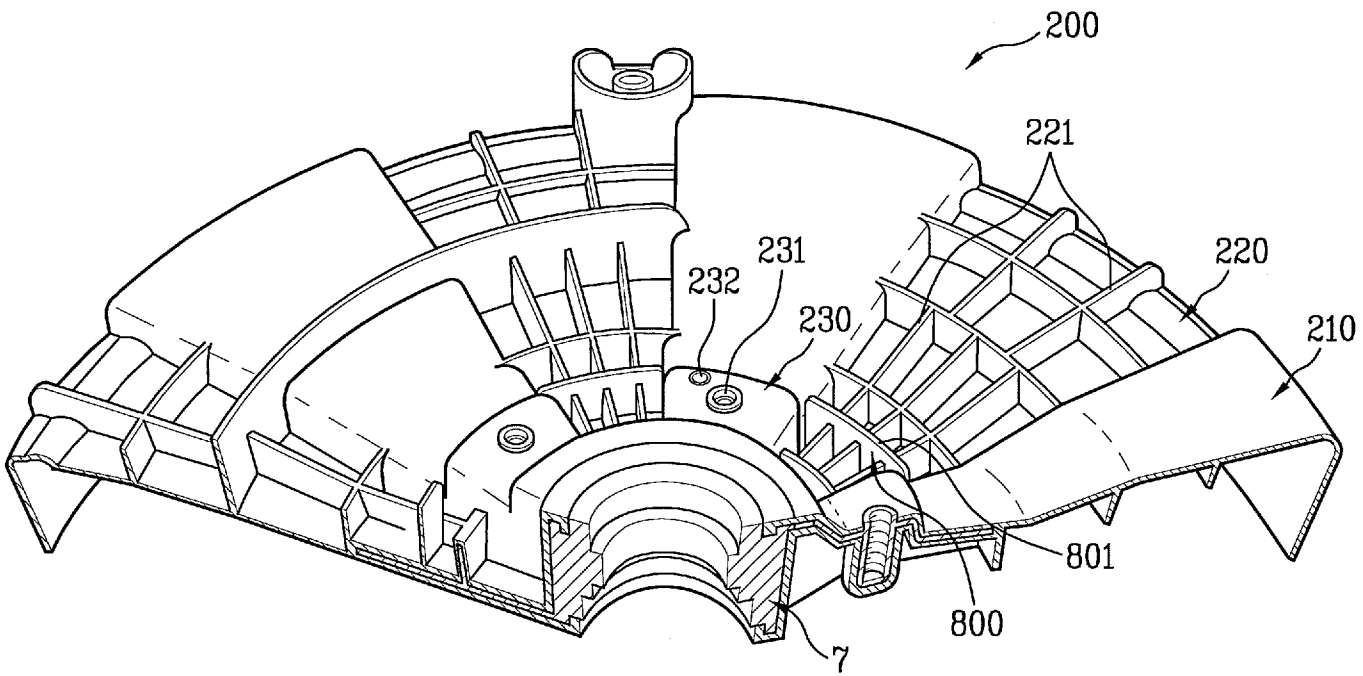
FIG. 6 is a partially cut-away perspective view illustrating a rear wall of the tub in the DDM drum type washing machine according to the first embodiment of the present invention.

As shown in FIG. 6, a plurality of step parts 210 and non-step parts 220 are formed on the rear wall of the tub 200.

The step part 210 is stepped to be projected outwardly in comparison with the non-step part 220. The plurality of step parts 210 are formed a predetermined distance toward a radial direction. Together with that, the non-step parts 220 are provided between the step parts 210 and not projected.

Especially, a plurality of reinforcement ribs 221 having a predetermined width are formed along a radial direction of the rear wall of the tub 200 and a circumference direction in a lattice shape a predetermined distance. The reinforcement rib 221 has a plate appearance.

The each reinforcement rib 221 prevents the tub 200 from being curved or bent when injection-molded and prevents the rear wall of the tub 200 from being deformed or bent during various cycles, for example, a washing or spinning cycle.

A plurality of fastening parts 230 are further formed in the center portion of the step parts 210 where the bearing housing 7 is provided, and stepped/projected backwardly. A first fastening hole 231 is formed on each fastening part 230 to fasten the stator 600 to the fastening part 230.

Thus, the stator 600 is fixed to the tub 200 and comprised in a motor, together with the rotor 5 provided outwardly adjacent to the stator 600.

Figure 7:
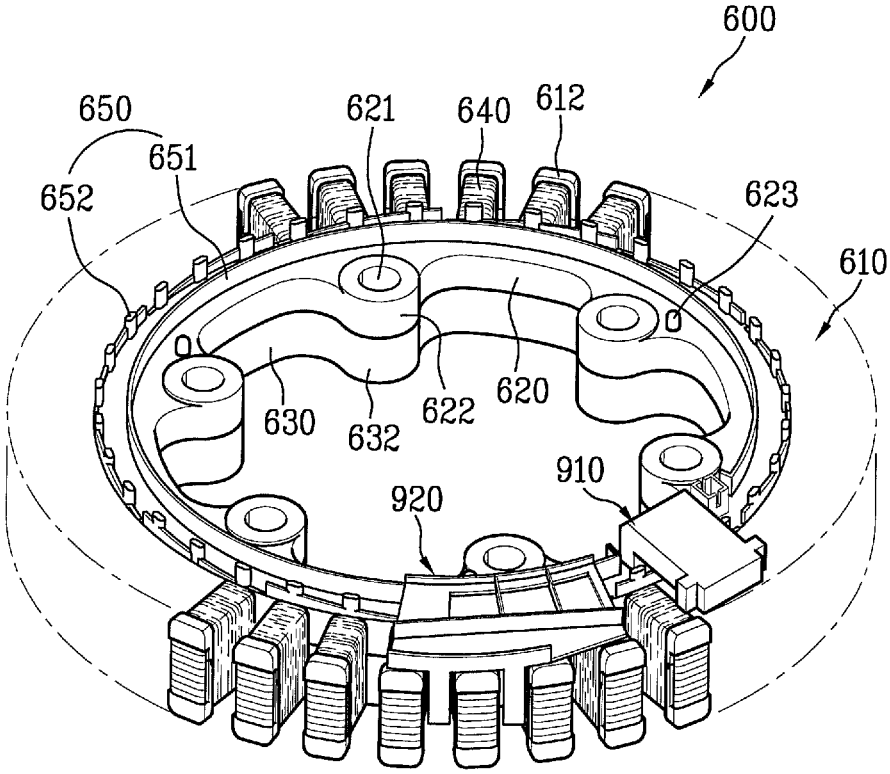
FIG. 7 is a perspective view of a stator according to the DDM drum type washing machine of the present invention.

As shown in FIG. 7, the stator 600 includes a core part 610, a coil 640, a pair of insulators 620 and 630 and a stator rib 650.

Iron plates including a base (not shown) and teeth 612 are multi-layered to form the core part 610.

Here, the teeth 612 have a T-shape, seen from a plane view, and the coil 640 is wounded around the teeth 612, and the base having an approximate ring shape defines a body of the core part 610.

Also, the pair of insulators 620 and 630 are made of insulation material, and formed in a ring shape, same as the shape of the core part 610, to surround a rear surface of the core part 610.

In addition, a plurality of projections 622 and 632, each having a second fastening hole 621 and 631 formed therein, are formed on am inner circumferential surface of each insulator 620 and 630, corresponding to each other. Then, each second fastening hole 621 and 631 is corresponding to each first fastening hole 231 of each fastening part 230 and fastened to each first fastening hole 321 by a fastening member.

The stator rib 650 may include a partition rib 651 and a winding rib 652. The partition rib 651 is formed on a front surface of the first insulator 620, which faces the tub 200, to separate the portion where the projection part 622 is formed from the portion and where the coil 640 is wounded. At that time, the partition rib 650 is formed in a ring shape having a predetermined height, which is high enough not to contact the partition rib 650 with the step part 210 of the tub 200.

The partition rib 651 prevents water, which might be leaked through the fastening portion between the stator 600 and the tub 200, from flowing into the portion where the coil 640 is wounded.

A winding rib 652 is formed between the partition rib 651 and the portion of the stator 600 where the coil 640 is wounded. Some of the connection wire, connected to be wounded around another tooth 612 after a stator coil of each phase is wounded around any one tooth 612, is wound to fix the winding rib 652. Thus, the partition rib 651 is formed in a ring shape along a circumferential direction and has various heights for each connection wire of the phases to secure the insulating distance each other.

The stator 600 further includes a hall sensor assembly 910 and a tap housing assembly 920 for power connection.

The hall sensor assembly 910 is provided on a front circumferential portion of the first insulator 620 to measure the position and the speed of the rotor 5.

The tap housing assembly 920 for power connection supplies power to the coil 640 of the stator 600. The tap housing assembly 920 for power connection is provided in a circumferential portion of the first insulator 620 and an end thereof is fastened to a front circumference of the first insulator 620. At that time, the hall sensor assembly 910 and the tap housing assembly 920 are spaced apart a predetermined distance.

The rotor 5 is provided in an outer portion of the stator 600, and the rotor 5 and the stator 600 are included with the motor.

At that time, the rotor 5 is made of iron material to transmit rotation power to the drum 3 by means of the shaft 4.

The shaft 4 passes through the rear wall of the tub 200 and the inside of the stator 600, so that the shaft 4 is fastened to the drum 3 in a state of being supported by the bearing housing 7.

The supporting part 800, specifically the supporting rib 801, supports the inner wall of the partition rib 651 formed on the first insulator 620, as shown in FIG. 5. Although not shown in the drawings, the supporting rib 801 may be configured to support the winding rib 652.

As shown in FIG. 6, the supporting rib 801 is formed on the portion of the non-step part 220, which is adjacent to the inner wall of the partition rib 651, and preferably, the supporting rib 801 is fixed to each reinforcement rib 221 formed on the non-step part 220 of the tub 200.

Also, the supporting rib 801 is high enough not to be contacted with the front surface of the first insulator 620 and, preferably, high enough to be contacted with the inner wall of the partition rib 651.

Here, the supporting rib 801 may be formed as one body with the non-step part 220 of the tub 200 when the tub 200 is fabricated, and alternatively may be formed as an auxiliary piece separated from the tub 200 to be fixed to the non-step part 220 of the tub 200.

It is preferred in connection with production cost and the reduction of man hours that the supporting rib 801 is formed as one body with the non-step part 220 of the tub 200.

In addition, the supporting rib 801 is formed on more than two non-step parts 220 facing each other and more preferably may be formed on each non-step part 220.

Since the portion where the partition rib 651 of the stator 600 is supported by the supporting rib 801 may be maximized, load is not concentrated on a particular portion of the partition rib 651, more specifically, any one supporting rib 801.

It is preferred that the width of each supporting rib 801 is wide enough to reinforce the strength of the rear wall of the tub 200, in addition to each reinforcement rib 221 of the tub. Here, the width is approximately 2~5 mm, which is the same as the width of the reinforcement-bead rib 221.

It is also preferred that the supporting rib 801 is roundly formed, tracing the same circular arc as that of the partition rib 651 of the stator 600.

That is for contacting the supporting rib 801 with the partition rib 651 so that the supporting rib 801 may support the partition rib 651. Moreover, since the load given to the partition rib 651 also may be dispersed by the appearance of the supporting rib 801, the damage may be prevented, which might be caused in the partition rib 651 due to partial concentration of load.

Preferably, a position determination groove 232 is further formed on the fastening part 230 of the tub 200 and a position determination protrusion 623 corresponding to the position determination groove 232 is further formed on the first insulator 620 of the stator 600 to insert the position determination protrusion 623 therein.

The position determination protrusion 623 and the position determination groove 232 are correspondingly fastened each other when the stator 600 is fastened to the tub 200 so that the position of the stator 600 is determined precisely.

A reference number 910 without detailed description is a hall sensor assembly and a reference number 920 without detailed description is a tap housing assembly for power connection.

Figure 8:
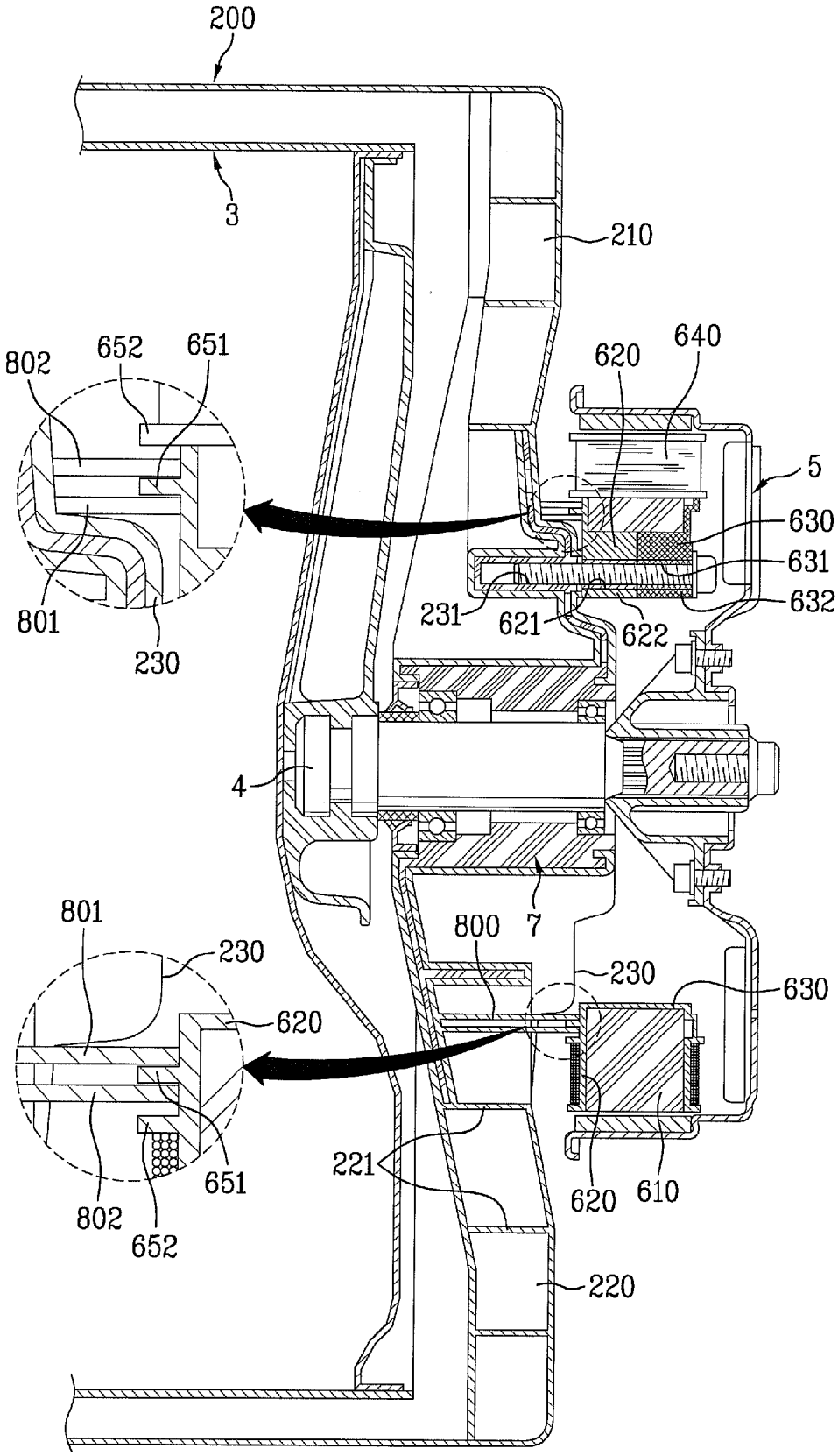
FIG. 8 is a longitudinal sectional view illustrating another embodiment of the fastening structure between the tub and the stator in the DDM drum type washing machine shown in FIG. 5.
Figure 9:
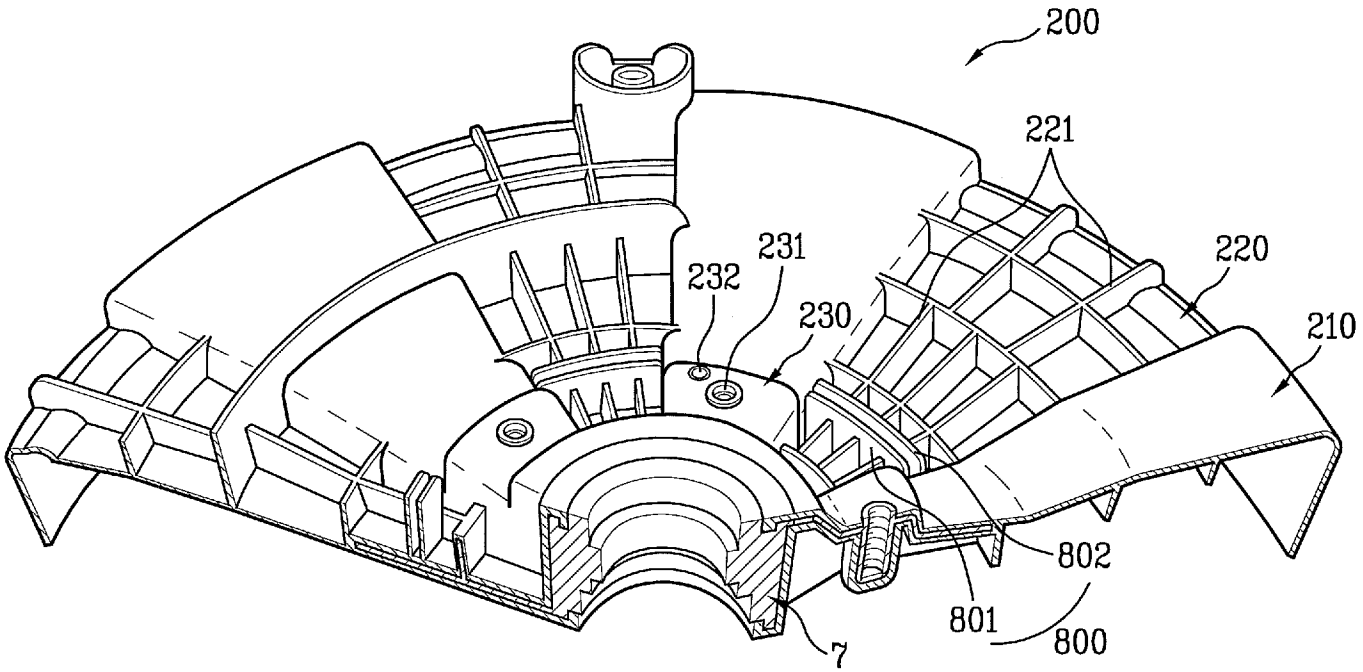
FIG. 9 is a partially cut-away view illustrating another embodiment of the rear wall of the tub in the DDM drum type washing machine shown in FIG. 6.

As shown in FIGS. 8 and 9, the supporting part 800 may further include a sub-supporting rib 802 provided in the step part 210 of the tub 200 to cover the outer wall of the partition rib 651, when the stator 600 is fastened to the tub 200.

Here, it is preferred that the sub-supporting rib 802 is formed as one body with the supporting rib 801.

The above structure is all for supporting the inner wall and the outer wall of the partition rib 651 securely.

That case may have an advantage that fastening the stator 600 to the rear wall of the tub 200 is getting easier.

In addition, it is more efficient to reinforce the strength of the non-step part 220.

Even when the drum type washing machine is put into operation and the vibration is generated in the tub 200 and the stator 600, the supporting rib 801 and the sub-supporting rib 802 support the entire portion of the partition rib 651 provided in the stator 600 to prevent damage of the fastening portion between the stator 600 and the tub 200.

A process of fastening the motor to the tub 200 of the drum type washing machine according to the first embodiment having the above configuration will be described.

First, each position determination protrusion 623 of the first insulator 620 provided in the stator 600 is correspondingly fastened to each position determination groove 232 of the fastening part 230 formed on the rear wall of the tub 200.

In that case, each supporting rib 801 formed on the non-step part 220 of the tub 200 is arranged inside of the partition rib 651 formed on the front surface of the first insulator 620. Hence, the first fastening hole 231 of the fastening part 230 is corresponding to the second fastening hole 621 and 631 formed each projection 622 and 632 of the stator 600.

At that time, each supporting rib 801 supports the inner wall of the partition wall 651. Thus, even though the stator 600 moves down due to the load thereof during the fastening the stator 600 to the tub 200, the damage of the position determination protrusion 623 can be prevented. In addition, since the position of the stator 600 is prevented from moving, the fastening work can be smoothly performed. As described above, the sub-supporting rib 802 supports the outer wall of the partition rib 651.

Once the stator 600 is fastened to the rear wall of the tub 200 by the above process, the drum 3 mounted within the tub 200 is fastened to the terminal end of the shaft 4. Hence, the rotor 5 is fastened to the other terminal end of the shaft 4. At that time, the shaft 4 is supported by the bearing housing 7 provided on the rear wall of the tub 200.

Accordingly, the motor is completely mounted to the tub 200 via the above process.

Referring to FIGS. 10 to 14, a second embodiment of the present invention will be described. In this embodiment, the same elements as above described embodiment are denoted by the same reference numerals and description thereof will be omitted.

Figure 10:
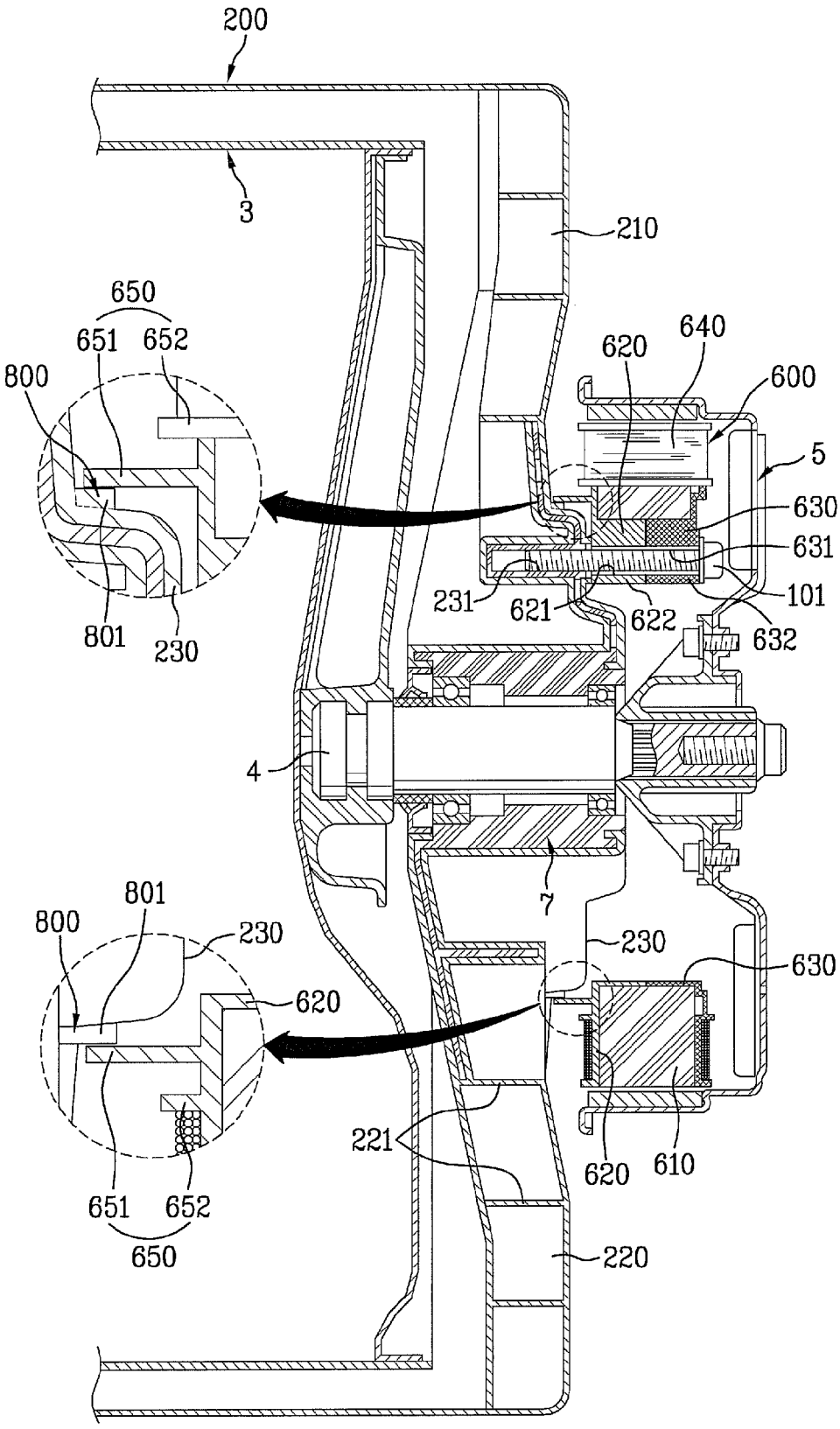
FIG. 10 is a longitudinal sectional view illustrating a fastening structure between a tub and a stator of a DDM drum type washing machine according to a second embodiment of the present invention.
Figure 11:
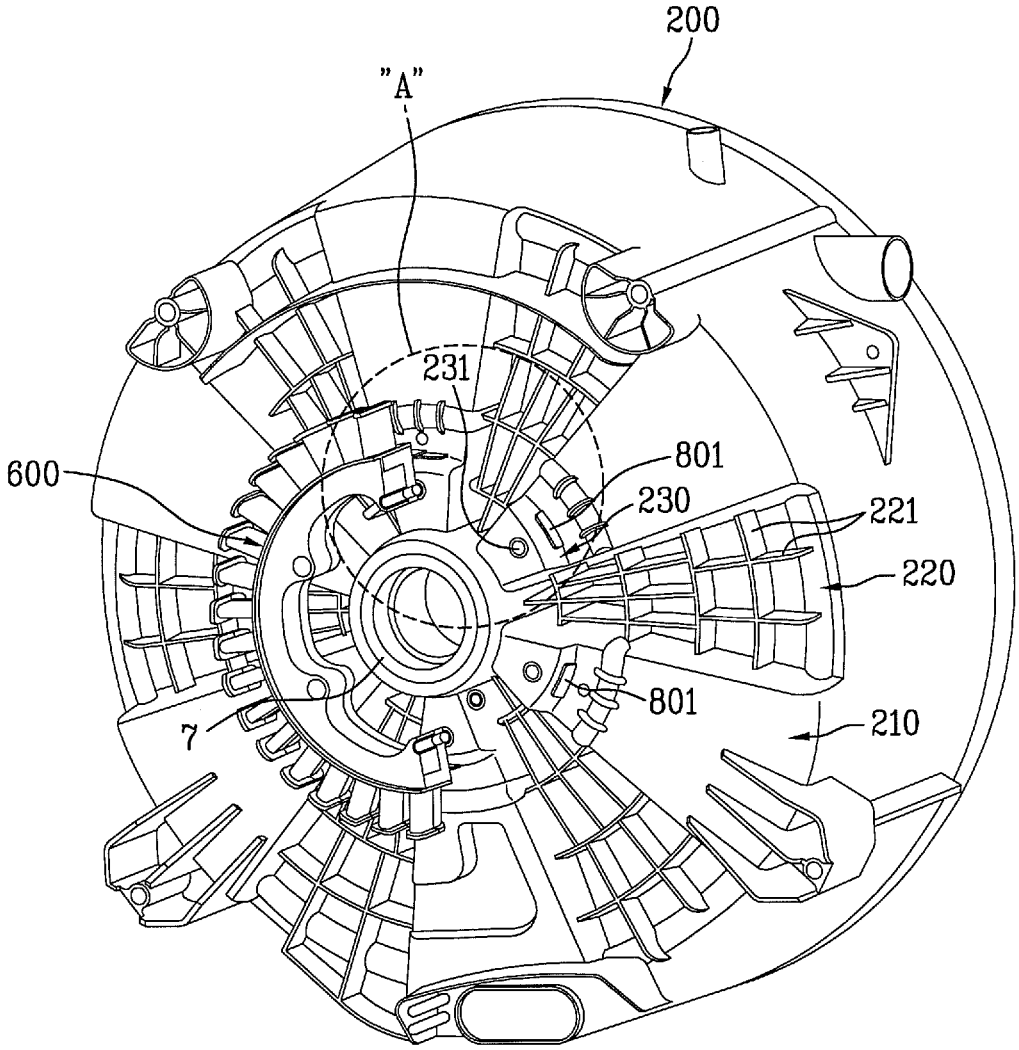
FIG. 11 is a perspective view illustrating a rear wall of the tub of the DDM drum type washing machine according to the second embodiment of the present invention.
Figure 12:
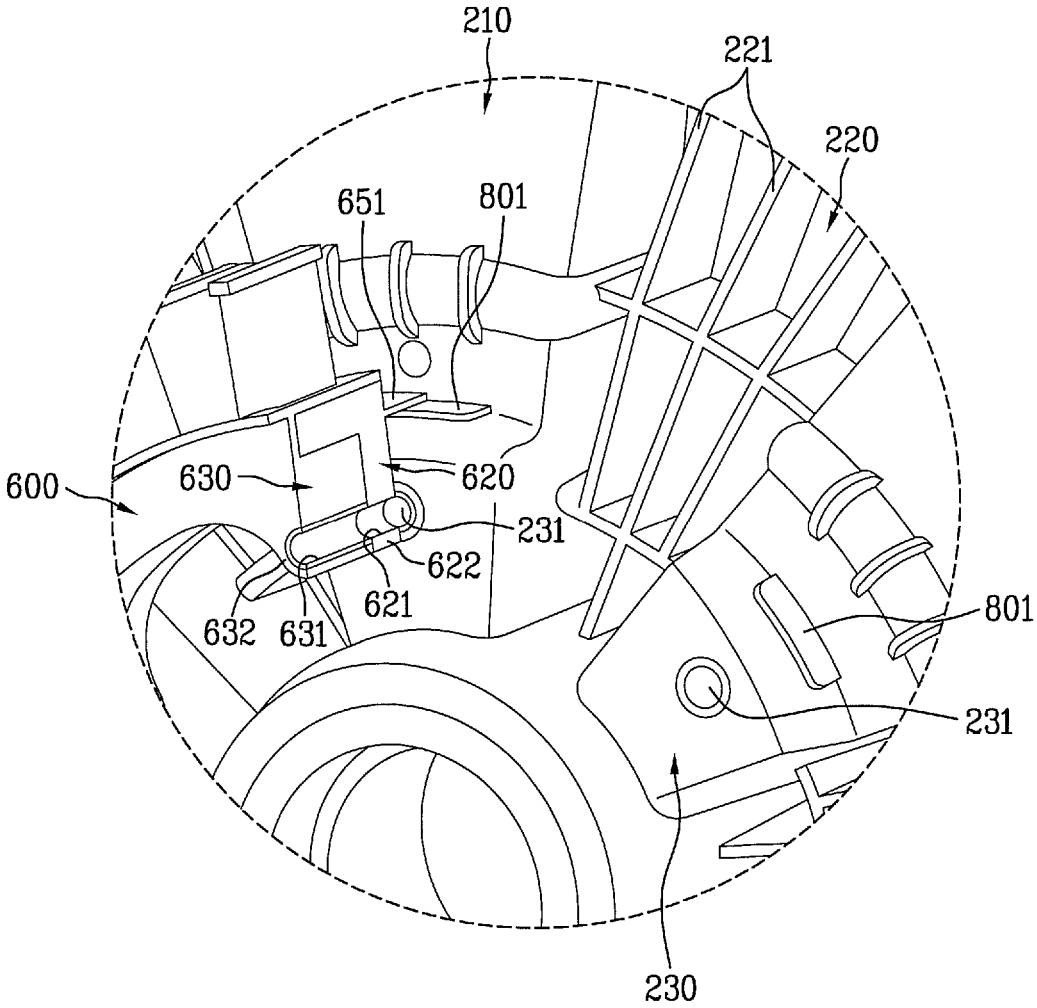
FIG. 12 is an enlarged view of "A" portion shown in FIG. 11.

In the second embodiment, a supporting part 800 supports a stator rib 650, too. More specifically, the supporting part 800 includes a supporting rib 801 to support a partition rib 651 formed on the first insulator 620, specifically an inner wall of the partition rib 651, as shown in FIGS. 10 to 12.

Unlike the first embodiment, the supporting rib 801 of this embodiment may be provided on a surface bent from the step part 210 out of surfaces of the fastening part 230 formed in the tub 200. That is, the supporting rib 801 is formed on the step part 210.

The right-and-left direction width of each supporting rib 801 may be determined to correspond the first fastening hole 231 to the second fastening hole 621 and 631, which means the fastening position between the stator 600 and the tub 200 in case that the supporting rib 801 is contacted with any one surface of the hall sensor assembly 910 provided in the first insulator 620 of the stator 600.

Alternatively, the right-and-left direction width of each supporting rib 801 may be determined to correspond the first fastening hole 231 to the second fastening hole 621 and 631 in case that the supporting rib 801 is contacted with any one surface of the tap housing assembly 920 for power connection provided in the first insulator 620 of the stator 600.

That is for preventing each fastening position between the stator 600 and the tub 200 from being different. Whereas, the fastening position between the stator 600 and the tub 200 is corresponded to by making the width of the supporting rib 801 appropriate.

Figure 13:
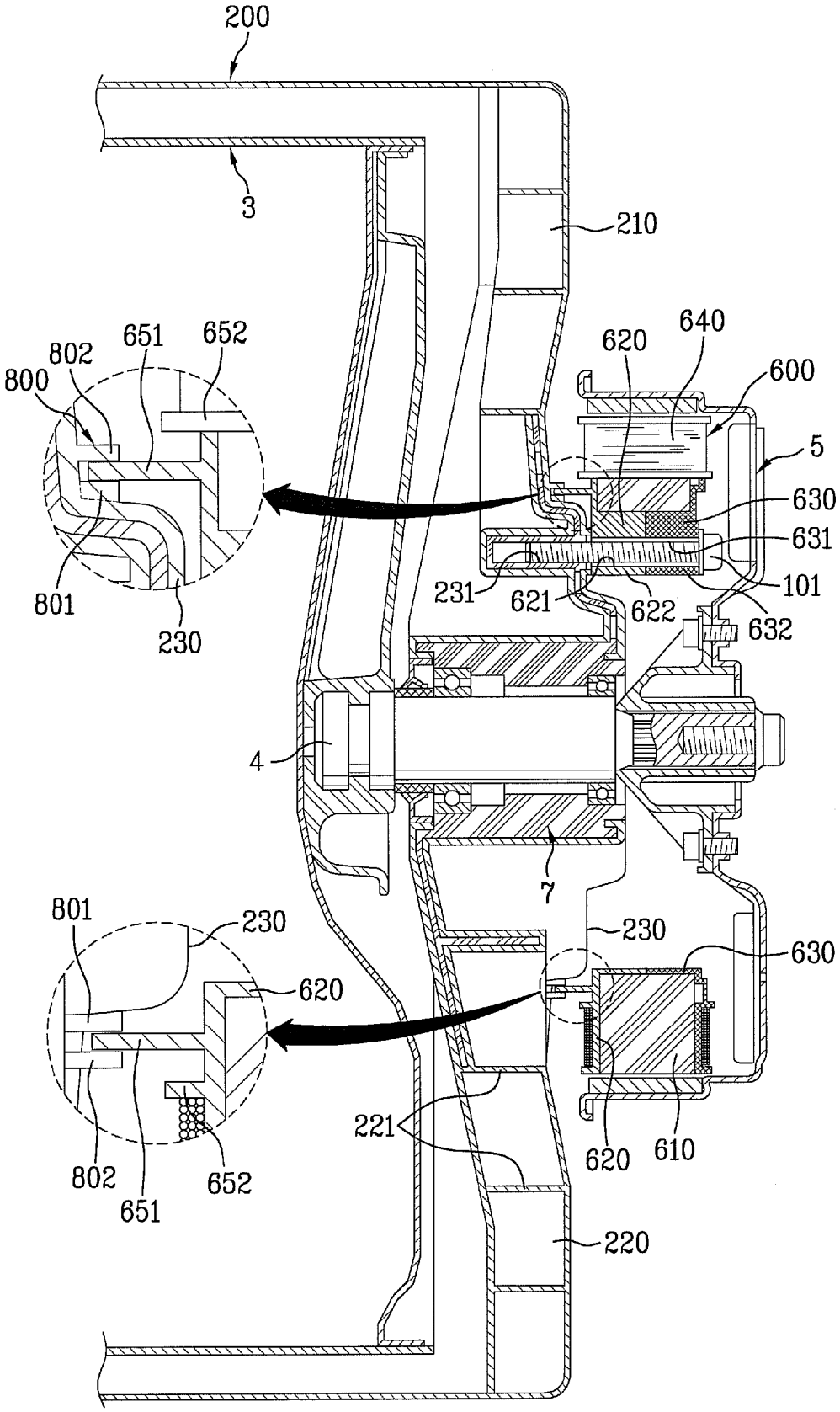
FIG. 13 is a longitudinal sectional view illustrating another embodiment of the fastening structure between the tub and the stator of the DDM drum type washing machine shown in FIG. 11.
Figure 14:
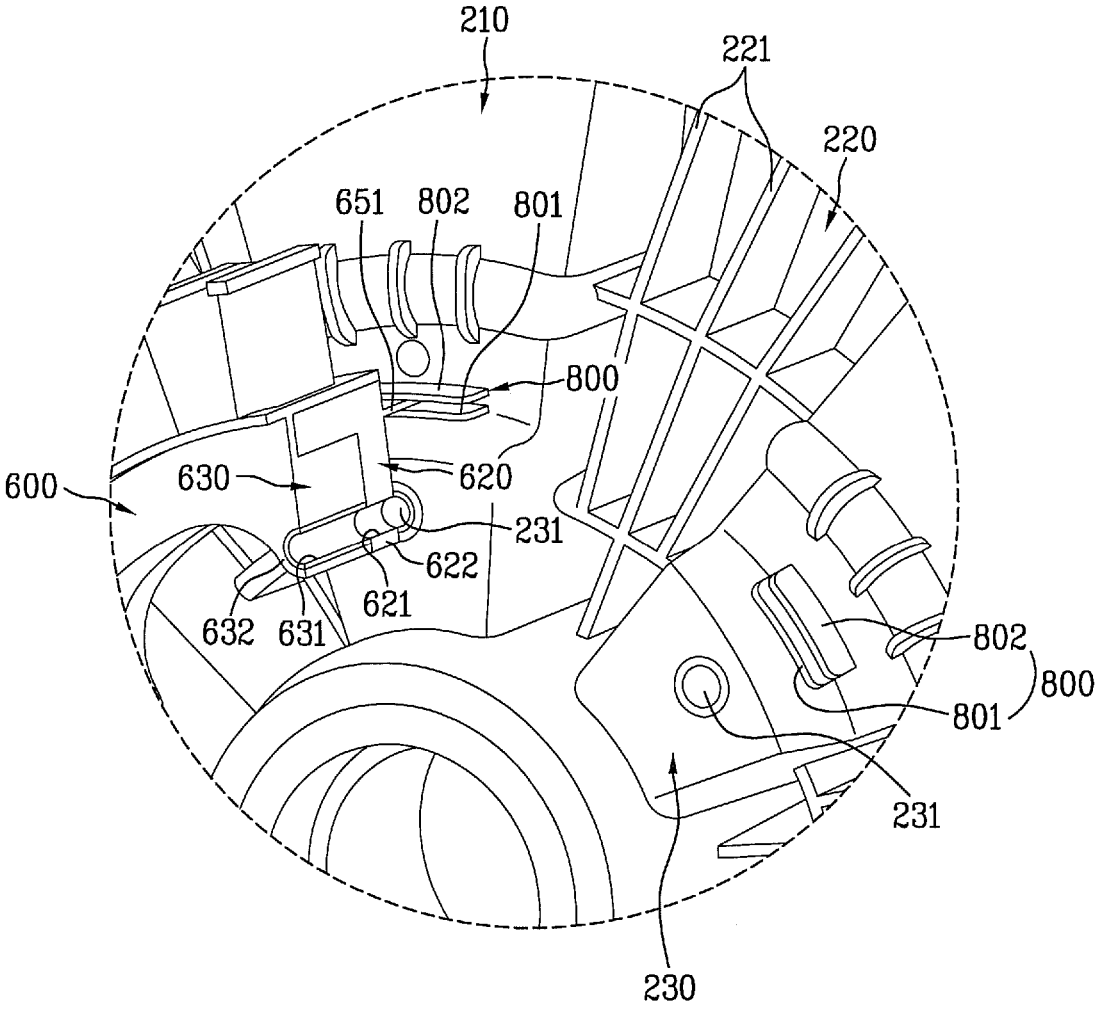
FIG. 14 is illustrating another embodiment of the rear wall of the tub according to the DDM drum type washing machine shown in FIG. 11.

By the way, as shown in FIGS. 13 and 14, the supporting part 800 according to this embodiment may further include a sub-supporting rib 802.

Here, since the function of the supporting part 800, more specifically the function of the supporting rib 801 and the sub-supporting rib 802 is the same as described in the first embodiment, the detailed description thereof will be omitted.

Figure 15:
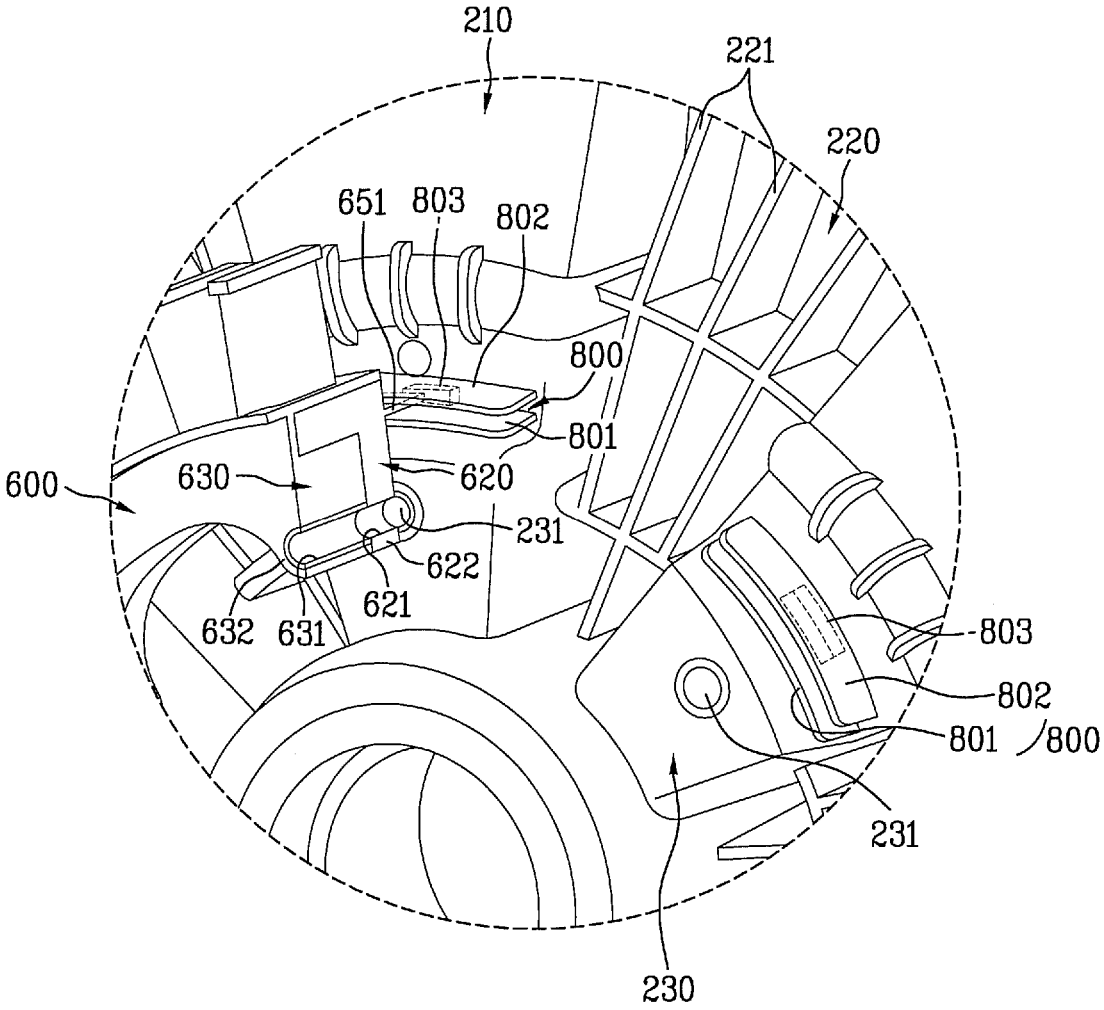
FIG. 15 is a perspective view illustrating key parts of a rear wall of a tub in a DDM drum type washing machine according to a third embodiment of the present invention.

Referring to FIG. 15, a third embodiment of the present invention will be described.

Much part of this embodiment is similar to the second embodiment but the fact that a supporting rib 801 has a predetermined friction power. For example, the supporting rib 801 is made of robber having compressibility to be contacted with an inner wall of a partition rib 651 formed on the stator 600, so that the partition rib 651 is supported by the supporting rib 801.

Alternatively, a sub-supporting rib 802 may be provided in this embodiment like the above embodiments.

Here, the supporting rib 801 made of robber is provided in this embodiment, because it can absorb vibration and also has less danger of damage.

In addition, a motion-proof bump 803 may be provided in an outer portion with respect to a radial direction of the supporting rib 801 to prevent the supporting rib 801 from moving. The motion-proof bump 803 prevents the stator 600 from being inclined toward any one direction, such that the fastening between the stator 600 and the tub 200 may be precise.

Here, the supporting rib 801 and the sub-supporting rib 802 may be provided as an auxiliary piece to be fixed to the rear wall of the tub 200, and the motion-proof bump 803 may be formed as one body with the rear wall of the tub 200.

Meanwhile, the function of the supporting part 800 including the supporting rib 801 and the sub-supporting rib 802 is the same as described in the above embodiments and the detailed description thereof will be omitted accordingly.

Figure 16:
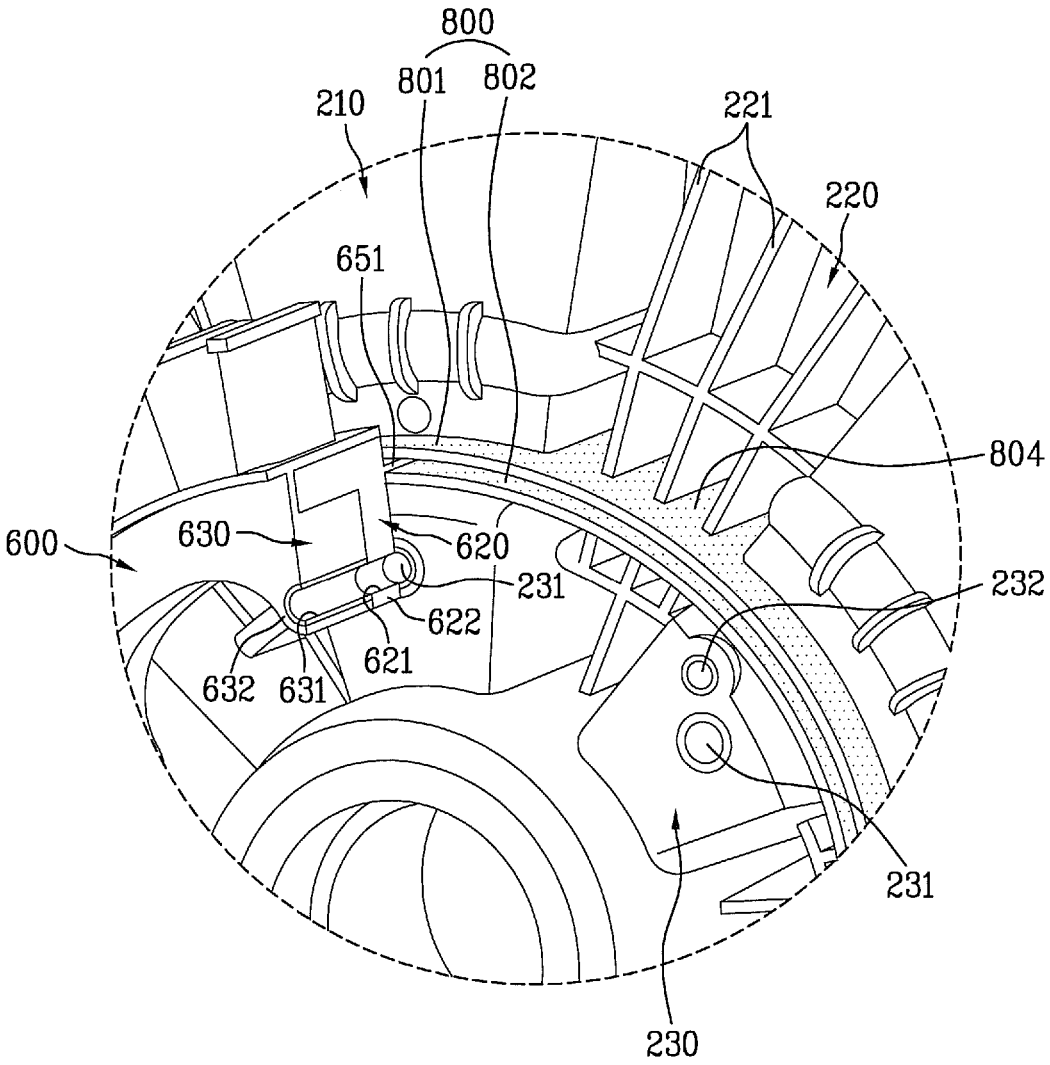
FIG. 16 is a perspective view illustrating key parts of a rear wall of a tub in a DDM drum type washing machine according to a fourth embodiment of the present invention.

Referring to FIG. 16, a fourth embodiment of the present invention will be described.

In this embodiment, a supporting part 800 for supporting a stator rib 650 is formed on a non-step part 220 as well as a step part 210 of the tub 200. Preferably, the supporting part 800 may be crossing the step part 210 and the non-step part 220 or may be formed in a ring-shape.

Also, in this embodiment, the supporting part 800 may include a supporting rib 801 and a sub-supporting rib 802 and, alternatively, the supporting part 800 may include only one rib, and the function thereof is the same as described in the above embodiments.

The supporting part 800 may be formed as one body with the rear wall of the tub 200, or made as an auxiliary piece to be fixed to the rear wall of the tub 200. In the latter case, the supporting part 800 may be made of robber.

Meanwhile, a fixing part 804 may be formed on some portion of the supporting part 800 to be fixedly inserted in a reinforcement rib 221 formed on a non-step part 220 of the tub 200. That is, the fixing part 804 is extended toward the rib 221 to be fixed between the reinforcement ribs 221.

Referring to FIGS. 17 to 21, a fifth embodiment of the present invention will be described. In this embodiment, a supporting rib 800 supports a winding rib 652 of a stator rib 650.

Figure 17:
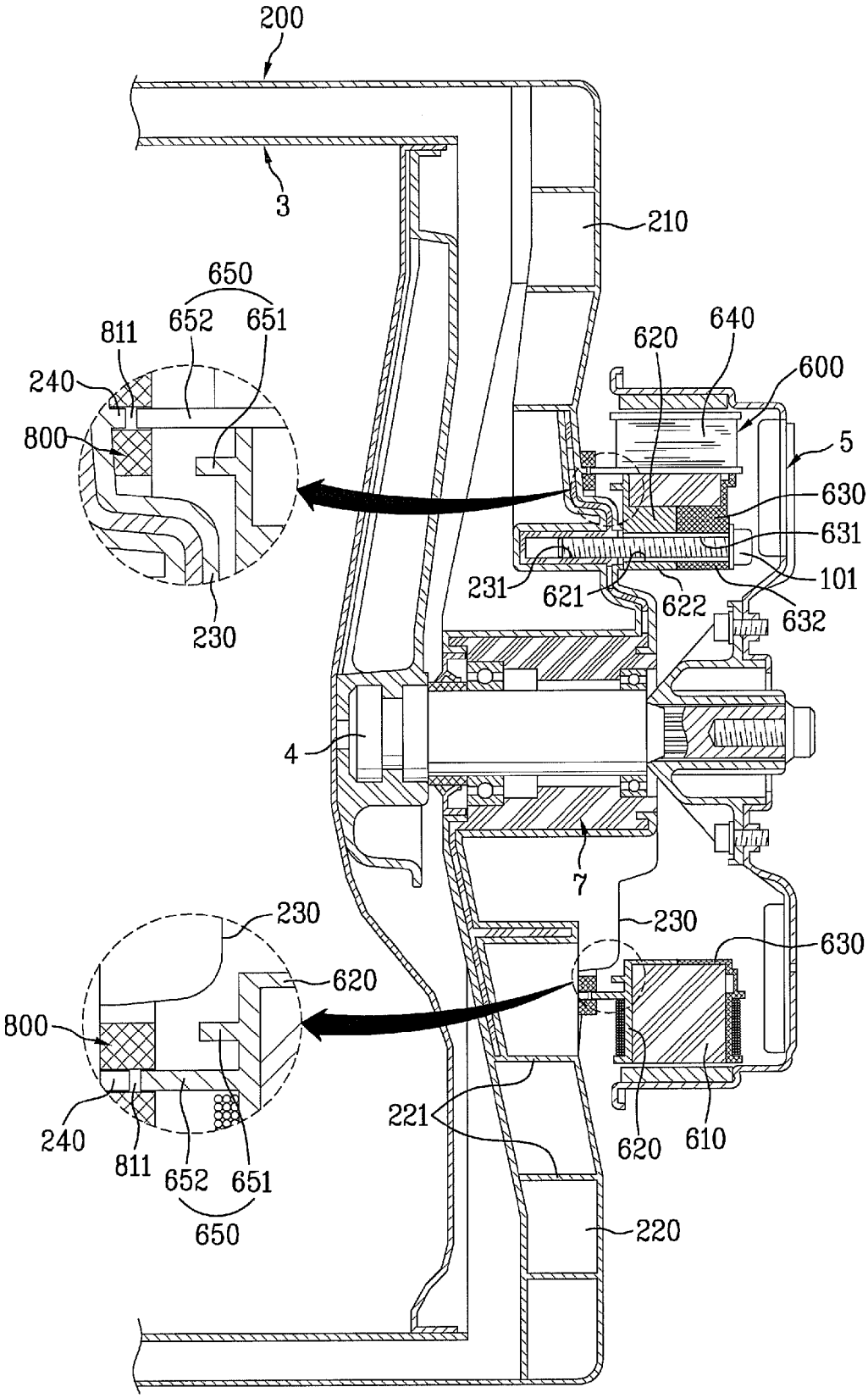
FIG. 17 is a longitudinal sectional view illustrating a fastening structure between a tub and a stator of a DDM drum type washing machine according to a fifth embodiment of the present invention.

FIG. 17 is a longitudinal sectional view schematically illustrating a structure of a DDM drum type washing machine according to the fifth embodiment of the present invention.

As shown in FIG. 17, the drum type washing machine according to the fifth embodiment of the present invention includes a tub 200, a stator 600, a rotor 5 and a supporting part 800.

In this embodiment, the supporting part 800 allows a winding rib 652 of a stator rib 650 formed on a first insulator 620 fixed to the rear wall of the tub 200.

The supporting rib 801 is provided between the rear wall of the tub 200 and the winding rib 652 of the stator 600.

Figure 18:
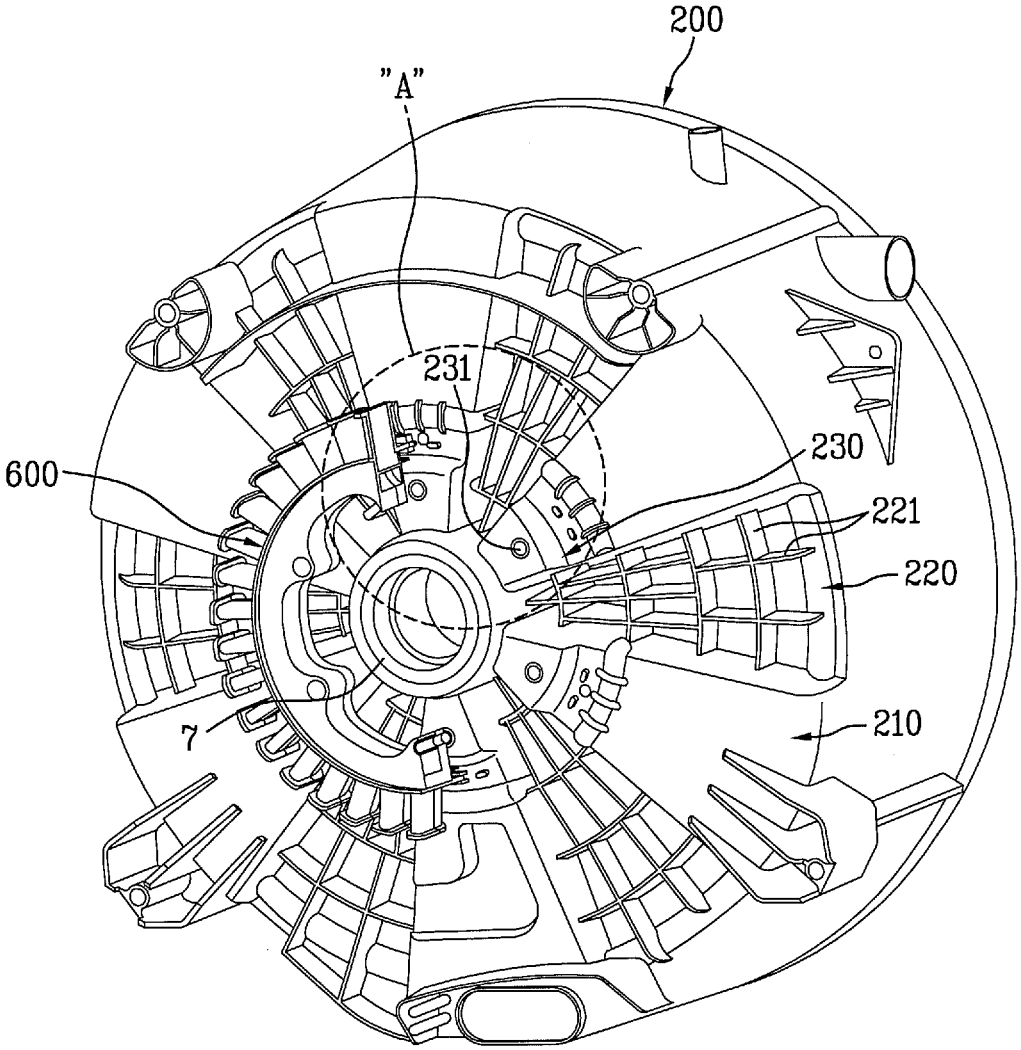
FIG. 18 is a perspective view illustrating a rear wall of the tub of the DDM drum type washing machine according to the fifth embodiment of the present invention.
Figure 19:
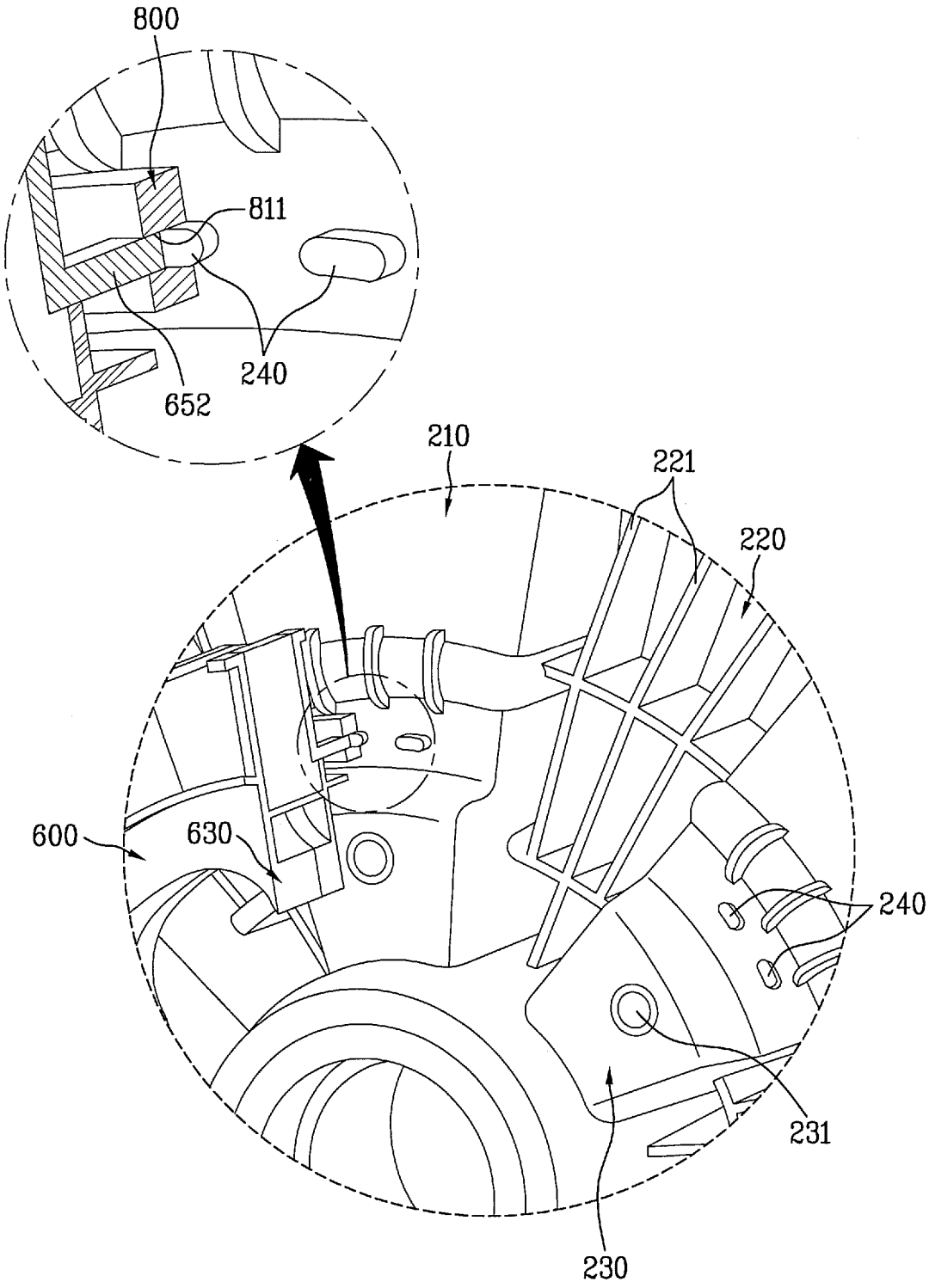
FIG. 19 is an enlarged view of "A" portion shown in FIG. 18.

Referring to FIGS. 17 to 19, the supporting part 800 will be described more specifically.

First of all, a front surface of the supporting part 800 is fastened to the tub 200 and a rear surface thereof is a bracket for fixedly insert the winding rib 652 of the first insulator 620 therein.

At that time, the supporting part 800, as shown in FIG. 6, may be formed as one body in a ring shape. Alternatively, although not shown in the drawings, the supporting part 800 may be made of plural pieces, which are separated from each other, and each piece may be arranged in a ring shape.

Also, a plurality of fastening holes 811 are formed on a front surface of the supporting part 800 to insert the winding ribs 652 therein. The fastening hole 811 may be a hole for passing through the supporting part 800, or a groove recessed on some portion of the supporting part 800. This embodiment of the present invention preferably embodies that the fastening hole 811 is a hole.

Together with that, fastening protrusions 240 are projected toward the supporting part 800 along the rear wall portion of the tub where the supporting part 800 is fastened. Here, the fastening protrusion 240 is inserted in the fastening hole 811 of the supporting part 800.

More specifically, each fastening protrusion 240 is inserted in a front portion of each fastening hole 811 and each winding rib 652 formed on the first insulator 620 of the stator 600 is inserted in a rear portion of each fastening hole 811.

Preferably, the supporting part 800 is made of different material from the tub 200, it is most preferred that the supporting part 800 is made of metal, because deformity thereof can be prevented even when the supporting part 800 supports the entire load of the stator 600.

Figure 20:
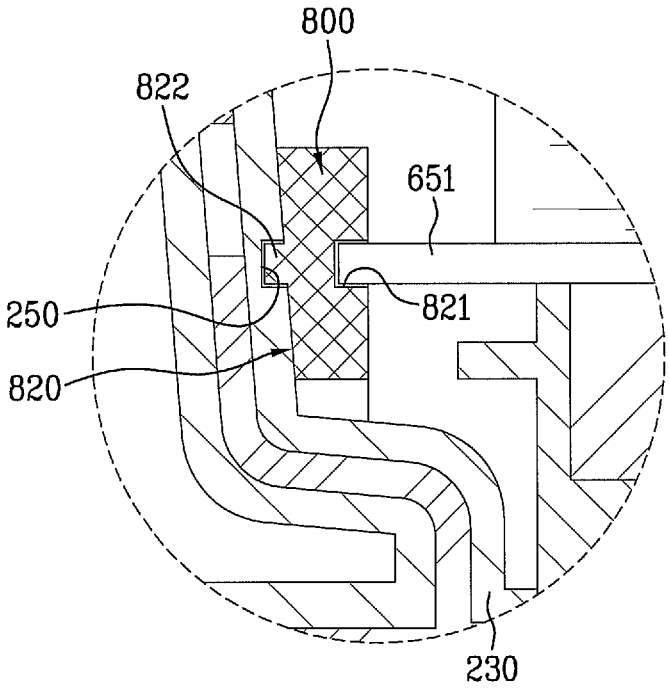
FIG. 20 is a sectional view illustrating another embodiment of the rear wall of the tub in the DDM drum type washing machine shown in FIG. 17.

By the way, this embodiment may be varied as shown in FIG. 20.

Referring to FIG. 20, the structure of the fastening between the supporting part 800 and the tub 200 will be described in detail.

A plurality of inserting grooves 821 and protrusions 822 are formed at the same time, and a plurality of fastening grooves 250 are formed on the rear wall of the tub 200 along the portion where the supporting part 800 is fastened.

Here, each inserting groove 821 is formed on a rear surface of the supporting part 800 to insert the winding rib 652 of the stator 600 therein. Also, each fastening protrusion 822 is formed on a front surface of the fixing part 820 to be inserted in each fastening groove 250 formed on the rear wall of the tub 200.

Figure 21:
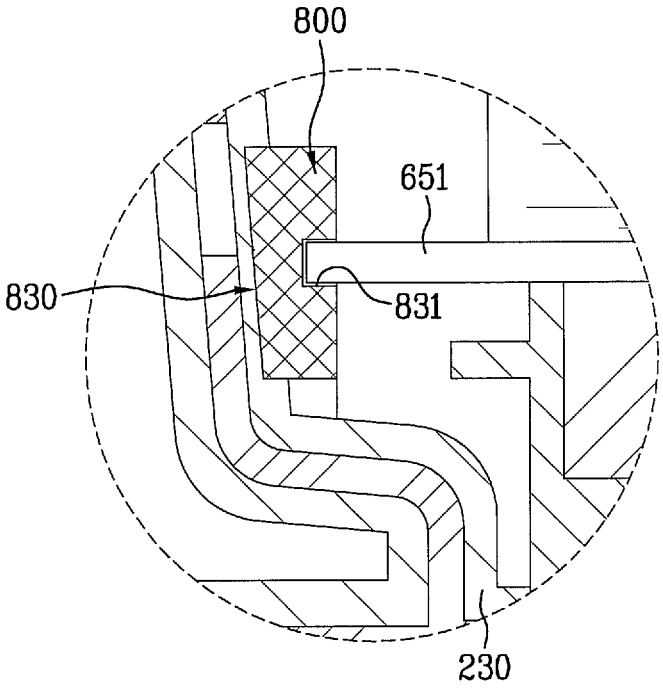
FIG. 21 is a sectional view of key part illustrating another embodiment of the rear watt of the tub in the DDM drum type washing machine shown in FIG. 17.

This embodiment may be varied as shown in FIG. 21.

That is, the supporting part 800 is formed as an auxiliary part separated from the tub 200, such that the supporting part 800 may be formed as one body with the tub 200, not fastened to the tub 200.

Thus, increase of production time and manpower loss, which might be caused due to the work for fastening the supporting part 800 to the tub 200, may be prevented.

The supporting part 800 is also formed in a ring shape, as described in the above embodiments. A plurality of fastening holes 831 are formed on a surface of the supporting part 800 to insert the winding ribs 652 of the stator 60 therein, respectively.

It is preferred that the supporting part 800 is made of different material from the material of the tub 200, and the reason there for is the same as described in the above embodiments.

Especially, it is preferred that the supporting part 800 is injection-molded on the rear wall of the tub 200 when fabricating the tub 200, because the supporting part 800 is made of different material from the tub 200. If the supporting part 800 is made of the same material as that of the tub 200, it is preferred that a shape of the supporting part 800 is additionally molded in a metal mold for the tub 200 to injection-mold the supporting part 800.

At that time, the supporting part 800 should be formed thick enough for each winding rib 652 to be inserted in each fastening hole 831 formed on the surface thereof.

Thus, it is preferred that some portion of the supporting part 800 is inserted in the rear wall of the tub 200, even when it is injection-molded in the rear wall of the tub 200 and another portion of the supporting part 800 is projected backwardly from the rear wall of the tub 200.

Alternatively, the supporting part 800 may not be formed that thick. That is, the supporting part 800 may be injection-molded for the fixing part 830 to be inserted in the rear wall of the tub 200, in that case, the length of each winding rib 652 formed on the first insulator 620 of the stator 600 is long enough to be inserted in each fastening hole 831 of the fixing part 830.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type washing machine, comprising:

a tub having a fastening part formed on a rear wall thereof;

a stator fastened to the fastening part of the tub, the stator having a core part having teeth formed thereon, a coil wound around the teeth, a first insulator that covers a front surface of the core part, and a second insulator that covers a rear surface of the core part;

a rotor that surrounds the stator;

at least one stator rib formed on a front surface of the first insulator; and a supporting part that projects from the rear wall of the tub and supports the at least one stator rib in an up-and-down direction when the stator is fastened to the fastening part of the tub, wherein the at least one stator rib comprises at least one partition rib that separates a portion where the stator is fastened to the fastening part from a portion where the coil is wound, and wherein the supporting part comprises at least one supporting rib that supports an inner wall of the at least one partition rib when the stator is fastened to the fastening part of the tub.

2. The drum type washing machine as clamed in claim 1, wherein a plurality of step parts and a plurality of non-step parts are formed on the rear wall of the tub in a radial direction and the plurality of step parts and the plurality of non-step parts are alternated in a circumference direction, and wherein the at least one supporting rib is formed as one body with at least one of the plurality of non-step parts.

3. The drum type washing machine as claimed in claim 2, wherein a plurality of reinforcement ribs is formed in the plurality of non-step parts to reinforce a strength of the plurality of non-step parts, and wherein the at least one supporting rib is fixed to each of the plurality of reinforcement ribs.

4. The drum type washing machine as claimed in claim 1, wherein a plurality of step parts and a plurality of non-step parts are formed on the rear wall of the tub in a radial direction and the plurality of step parts and the plurality of non-step parts are alternated in a circumference direction, and wherein the at least one supporting rib is provided as an auxiliary piece separate from the tub that is fastened to at least one of the plurality of non-step parts of the tub.

5. The drum type washing machine as claimed in claim 1, wherein the at least one supporting rib is positioned such that the at least one supporting rib contacts the inner wall of the at least one partition rib when the stator is fastened to the fastening part of the tub.

6. The drum type washing machine as claimed in claim 1, wherein the supporting part further comprises at least one sub-supporting rib that covers an outer wall of the at least one partition rib when the stator is fastened to the fastening part of the tub.

7. The drum type washing machine as claimed in claim 1, wherein a plurality of step parts and a plurality of non-step parts are formed on the rear wall of the tub in a radial direction and the plurality of step parts and the plurality of non-step parts are alternated in a circumference direction, and wherein the at least one supporting rib is provided on at least one of the plurality of step parts of the tub.

8. The drum type washing machine as claimed in claim 7, wherein a right-and-left direction width of the at least one supporting rib is configured so that the fastening part of the stator corresponds to the fastening part of the tub, in a case in which the at least one supporting rib contacts with any one side surface of a hall sensor assembly provided on the first insulator or a tap housing assembly for power connection.

9. The drum type washing machine as claimed in claim 7, wherein the at least one supporting rib has a predetermined friction force in a state of being in close contact with the inner wall of the at least one partition rib so as to prevent the at least one partition rib from moving.

10. The drum type washing machine as claimed in claim 1, wherein the supporting part further comprises at least one motion-proof bump formed in an outer portion with respect to a radial direction of the at least one supporting rib that prevents the supporting part from moving, and wherein the at least one supporting rib is made of compressible rubber.

11. The drum type washing machine as claimed in claim 1, wherein the at least one supporting rib is formed in a ring shape so as to surround the fastening part of the tub.

12. The drum type washing machine as claimed in claim 11, wherein a plurality of step parts and a plurality of non-step parts are formed on the rear wall of the tub in a radial direction and the plurality of step parts and the plurality of non-step parts are alternated in a circumference direction, and wherein the at least one supporting rib crosses the plurality of step parts and the plurality of non-step parts.

13. The drum type washing machine as claimed in claim 12, wherein the at least one supporting rib is provided as an auxiliary piece separate from the rear wall of the tub and fastened to the rear wall of the tub.

14. The drum type washing machine as claimed in claim 13, wherein a plurality of reinforcement ribs is provided in the plurality of non-step parts to reinforce a strength of the plurality of non-step parts, and wherein a fixing part is formed on a portion of each of the at least one supporting rib that projects toward each of the plurality of reinforcement ribs to be fixed between the plurality of reinforcement ribs.

15. The drum type washing machine as claimed in claim 1, wherein the at least one stator rib comprises at least one winding rib that projects forwardly along a front surface circumference of the first insulator therearound which a connection wire of the coil is wound.

16. The drum type washing machine as claimed in claim 15, wherein the supporting part comprises a bracket having a front surface thereof fastened to the tub and a rear surface to which the at least one winding rib is fastened.

17. The drum type washing machine as claimed in claim 16, wherein a fastening hole is formed on the bracket and the at least one winding rib is inserted in the fastening hole so as to be fastened to the bracket.

18. The drum type washing machine as claimed in claim 15, wherein the supporting part and the tub are made of different materials.

* * * * *